US006213201B1

(12) United States Patent
Renkis

(10) Patent No.: US 6,213,201 B1
(45) Date of Patent: Apr. 10, 2001

(54) TIGHT SANDS GAS WELL PRODUCTION ENHANCEMENT SYSTEM

(76) Inventor: Alan I. Renkis, 5139 Wolf Rd., Erie, PA (US) 16505-1343

( * ) Notice: Subject to any disclaimer, the term of this patent is extended or adjusted under 35 U.S.C. 154(b) by 0 days.

(21) Appl. No.: 09/285,483

(22) Filed: Apr. 2, 1999

Related U.S. Application Data

(60) Provisional application No. 60/081,468, filed on Apr. 13, 1998.

(51) Int. Cl.[7] ..... E21B 34/16; E21B 43/12

(52) U.S. Cl. ..... 166/53; 166/66

(58) Field of Search ..... 166/372, 53, 66, 166/66.5, 75.12, 68

(56) References Cited

U.S. PATENT DOCUMENTS

| | | | | |
|---|---|---|---|---|
| 3,053,188 | | 9/1962 | Dining et al. . | |
| 3,203,351 | | 8/1965 | Gillis . | |
| 3,266,574 | | 8/1966 | Gandy . | |
| 3,396,793 | | 8/1968 | Piper et al. . | |
| 3,863,714 | | 2/1975 | Watson, Jr. . | |
| 4,150,721 | | 4/1979 | Norwood . | |
| 5,146,991 | * | 9/1992 | Rogers, Jr. | 166/53 |
| 5,878,817 | * | 3/1999 | Stastka | 166/53 |
| 5,957,200 | * | 9/1999 | Majek et al. | 166/53 |
| 5,984,013 | * | 11/1999 | Giacomino et al. | 166/53 |

* cited by examiner

*Primary Examiner*—William Neuder

(57) ABSTRACT

A system for enhancing gas production from 'tight sands' gas wells by the use of expansion tanks, designed to accept the discharged volume of gas and well fluids from at least one production cycle at a reduced pressure, plumbed in a unique manner, and controlled by strategically located switch gauges, that allow naturally controlled fluid clean-out cycles. The purpose of this invention is to eliminate well shut-ins and gas loss, experienced with conventional gas production methods, and to allow more efficient exhaustion of predicted natural gas well reserves, with minimal well supervision and maintenance expense.

2 Claims, 2 Drawing Sheets

TIGHT SANDS GAS WELL PRODUCTION ENHANCEMENT SYSTEM

TIGHT SANDS GAS WELL PRODUCTION ENHANCEMENT SYSTEM
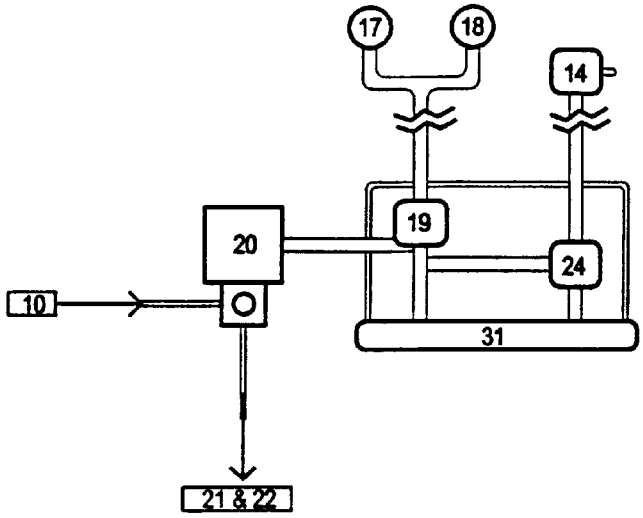
Figure 2. Electric circuit.
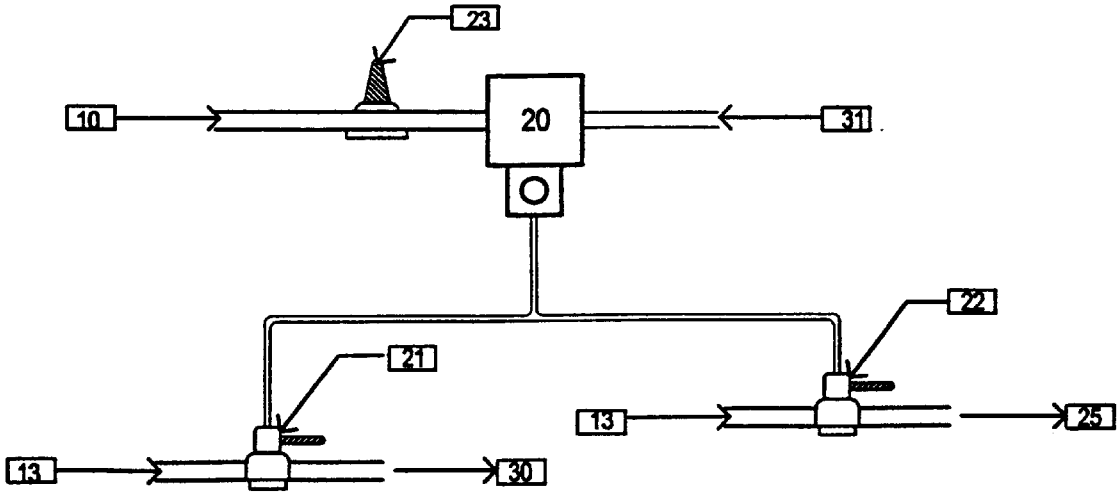
Figure 3. Pressure circuit.

TIGHT SANDS GAS WELL PRODUCTION ENHANCEMENT SYSTEM

REFERENCE TO PRIOR FILED APPLICATION

This application claims the benefit of U.S. Provincial Patent Application Ser. No. 60/081,468, Filed: Apr. 13, 1998

BACKGROUND

The production of gas from 'tight sand' deep wells has always created a challenge to gas well operators. In many areas of the United States, pockets of combined gas, oil and brine deposits are entrapped within porous sandone formations. In the Northern Pennsylvania, Ohio, and Northwestern New York State gas exploration areas, hundreds of gas wells have been drilled into such formations. In order to achieve practical gas production from such wells, it has been the general practice to set up a two tube or pipe system to enable effective removal of well fluids, i.e. oil and brine, that interfere with gas production.

The more sophisticated and state of the art systems use an electronic control to allow preset cycling of production and fluid removal periods, as described in U.S. Pat. Nos. 4,150,721, and 5,146,991, however some older patents, i.e. U.S. Pat. Nos. 3,053,188, 3,203,351, 3,266,574, 3,396,793, and 3,863,714, have been investigated, and have described some unique instrumentation, utilizing well pressure entirely to control well cycling and operating functions. The technology covered in these patents and many published articles concerning the art, all have contributed to define the gas production methods to the present level, and may be used in conjunction with the subject invention.

As a rule, operator experience and frequent attention to an individual well assures satisfactory operation, and adequate production from the 'tight sands' gas wells for significant periods of time. Many gas wells have produced profitably for periods exceeding 10 or 15 years. When the wells are depleted past their prime, however, the cost of production, i.e. the time, effort, and related expenses to keep the wells producing, may begin to exceed their income. Usually, only 30 to 50% of the predicted gas formation reserves may have been extracted at this point, wasting the remainder of the potential capacity. The customary decision then is to 'plug', or cement the well, as required by law. This procedure involves the complete cementing of the well hole, at substantial cost to the gas well operator.

The problem with conventional gas production methods from 'tight sands' wells has been the inability to predictably adjust to the changes in the production capability of the well. The decisions to produce, and fluid removal on a predicted schedule, have been left to the experience and skill of the well tender. Quite often, the well may be overproduced, it becomes 'waterlogged', and the residual natural gas pressure is incapable of 'lifting' the accumulated fluids from the well. Extended periods of 'shut in' are then necessary to recover the pressure, and to force the excess fluids back into the formations; as a result, considerable production time is lost. Secondly, this shut in period is followed by exhausting, or 'blowing' the well to the atmosphere, in order to remove the excess fluids and 'clean up' the well. This loss of time and natural gas results in considerable loss of revenue. A more efficient production method is called for to fully utilize these untapped gas reserves. The inventor has developed and successfully proven such a system to overcome the above mentioned production deficiencies, and allow nearly complete exhaustion of the predicted reserves. It is identified as 'Tight Sands Gas Well Production Enhancement System', and described herein.

SUMMARY OF INVENTION

The majority of problems in producing from the above mentioned 'Tight Sands' formation gas wells stem from the inability to feed off the gas stream from a well clean out cycle at an adequate flow rate to allow a relatively resistance free upwards travel of gas and accumulated well fluids from the internal tubing of the gas well. The resistance to gas flow is caused by a number of factors, including fluid separators, gas pressure regulators, limited size of the external feed plumbing, as well as the inability of the sales gas distribution line itself to receive a significant quantity of gas expelled from the short clean out cycle. It was obvious that some method must be devised to eliminate, or minimize these gas flow restrictions and to design an automatic and self regulated means to produce gas from these formations. The very heart of this invention is the incorporation of ample volume, enclosed pressure vessel(s), prior to the above mentioned devices that restrict gas flow, in order to reduce the back pressure caused by these restrictive devices also eliminating the need of a conventional gas separator before gas pressure regulation. Through experimentation, it has been determined that such an approach was indeed practical, and performed quite satisfactorily with either one, or additional expansion tanks plumbed in series. The choice of one, or more tanks is determined by economic and space limitations, however, a two tank system was found to be the most practical to assure a supply of a clean and dry gas stream, requiring a minimum of accessory operations.

The next step was to design a fully automated control system to react to the natural ability of the gas well to complete its own clean out cycle. This was accomplished by incorporating pressure activated switch gauges that form and electric circuit upon reaching a predetermined pressure setting. One gauge is necessary to monitor the well tubing pressure, and the second, the expansion tank pressure. The switch gauges are placed in electrical series, and upon closing the circuit, a time delay relay is activated to operate an electromagnetic slave valve that provides the pressure drawn from the annulus of the gas well, to open and close the pressure operated valve to the expansion tanks, and the tubing valve to the gas sales line. During normal gas feed off from a 'clean' gas well, the tubing valve is open, and the valve to the expansion container is closed. At the beginning of a clean out cycle, the tubing valve is closed, and the expansion container valve opened simultaneously, to allow the unencumbered discharge of the gas and well fluids. The control relay is set on a predetermined time delay to allow the complete exhaustion of the tubing content, but it is also dependent upon a second time delay relay that maintains the electric circuit continuity. This continuity is disrupted when a steel plunger, or rabbit, that follows the discharge of the fluids passes a magnetic sensor at the top of the production tubing; this acts as a switch to break the electric circuit to close the electromagnetic slave valve that, in turn, closes the expansion tank valve, and opens the valve to the production tubing feeding the sales line. The gas that has been accumulated in the expansion tank volume is now fed off preferentially into the sales line, controlled by a pressure regulator, allowing the well to recover, and upon reaching the pressure of the sales line, will allow the production to resume directly from the well tubing once more. Gas is produced from the tubing until it accumulates the predetermined fluid level, observed as a pressure differential, to trigger the switch gauges that initiate another clean out cycle. This electronic relay circuitry in combination with the electromagnetic valve controls is identified as A Simplified Control Mechanism. There are other available, but more complex controls that will also perform the time delay and shut off functions, and are referenced herein, but they are unnecessarily complex and costly for this specific application.

DESCRIPTION OF DRAWINGS

FIG. 2. represents the electrical circuits and layout necessary to operate the gas well according to this invention.

FIG. 3. shows the pressure operated devices and the plumbing set up to function the well according to this invention.

DETAILED DESCRIPTION OF DRAWINGS

Figure 1:
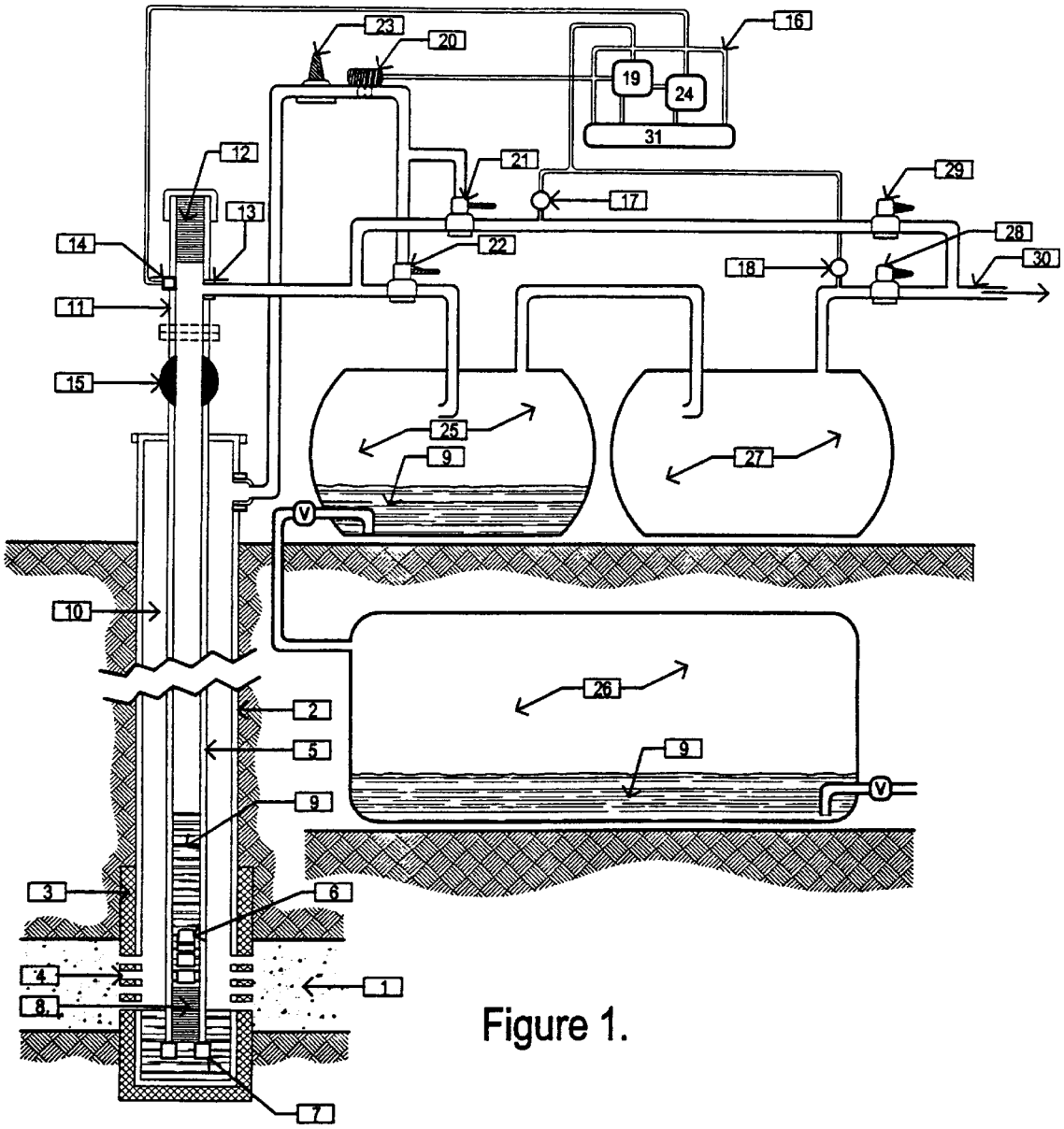
FIG. 1. provides a schematic diagram of a deep gas well construction and equipment layout, required to operate according to this invention.

This invention proposes to avoid the 'waterlogged' conditions, long shut-ins, and virtually eliminates the loss of gas that historically had to be exhausted to the atmosphere to enable well clean out.

A 'tight sands' gas well production system involves drilling of a six to ten inch access hole past the target gas producing zones 1, the typical production system involves the inserting the larger pipe 2, or casing, past the dedicated production zones and cementing 3 the casing past these identified gas bearing zones. The casing is then perforated with focused access holes 4 at the identified formations, and the sandstone formations are fractured (fracked) under high pressure. A sand slurry is pumped and deposited into these 'collapsed porous zones, to allow relatively free passage of gas and well fluids from the gas well. A smaller tubing string 5, is set within this casing to provide an effective way to produce gas and contain the well fluids for efficient removal from the well.

The most practical method of fluid removal today, involves the use of a steel free floating piston 6, or plunger, commonly referred to as the 'rabbit', that is inserted into the inner tubing 5. It is allowed to settle to the bottom of the open ended tubing string, that is set just below the level of the gas bearing formations. A retainer seat nipple 7 and a bottom hole spring 8 are fitted at the bottom of this tubing string to absorb the shock of the falling 'rabbit', and prevent its travel through the end of the tubing. The fluids 9 that collect above the plunger are brought up on a preset cycle by releasing pressure at the well head, propelled by the 'annular' 10 (space between the outer casing, and the inner tubing) pressure of the well.

Above the well surface, the top terminal section of the tubing string is referred to as the 'lubricator' 11, that contains a second spring 12 to absorb the shock of the ascending piston. The 'lubricator' also consists of a gas and well fluid discharge line 13, and a magnetic sensor location 14, located just above a 'full-port' shut off valve 15.

According to this invention, the method involves the installation of expansion tanks 25 and 27 at the well head location; their capacity designed to accept an amount of gas produced during each 'naturally controlled' fluid removal cycle, at a reduced pressure. This allows the accumulated fluids, extracted from the gas bearing formations, to rise from the well through the internal tubing 5 ahead of the 'rabbit' 6, propelled by the pressure from the annulus 10, with minimal back-pressure. The invention further consists of a simplified control mechanism 16, FIG. 2., that is activated when predetermined conditions are met to allow an automatic clean out cycle. The controls consist of two pressure switch gauges 17 & 18 that are wired in electrical series to act as a relay switch when the circuit is completed. The time delay relay 19 operates a small three way electromagnetic solenoid 'slave' valve 20, that, upon activation, will close a pressure operated ball valve 21 to the production line, and simultaneously open a similar, larger ball valve 22, or a diaphragm motor valve, if desired, to expel the gas and fluids from the tubing into the first expansion tank 25. A constant, regulated 23 pressure for the 'slave' valve and the two control valves is drawn from the gas well's annulus 10. The electric and electronic devices used in this invention may be powered 31 by Alternating (AC), or Direct (DC) Current, depending on the availability of the source, and the required devices. For remote locations, DC power is preferred, and may be complemented with Solar Panels to recharge batteries, and maintain a constant voltage.

When the free riding steel piston 6, or 'rabbit', bringing up the fluid 9, reaches the top of the tubing string 5, it passes by a magnetic sensor 14 that momentarily disrupts the electrical circuit. The magnetic sensor is used as an external switch to operate the second time delay relay 24, that will open the electrical circuit to close the 'slave' valve 20, in turn, closes the valve 22 to the expansion tanks, and simultaneously opens the valve 21 from the well to the supply line once again. The well is now ready for the next cycle, and will react only after it has recovered its natural ability to resume production, as signaled by closing the electrical circuit of the preset pressure switch gauges 17 and 18.

In a typical set-up, two identical expansion tanks are installed. The first tank 25, approximately 1,000 gallon (pressurized, max. 300 psi.) capacity, will accept and retain all the well fluids, as well as the gas that is produced during the automatic clean-out cycle. These fluids may be transferred automatically or manually, at a convenient time, to a fluid holding tank 26. A second expansion tank 27, normally of equivalent capacity, is connected directly to the first tank, and is plumbed to accept only the gas produced from this cycle. The gas from this second tank is fed off at a regulated pressure 28 slightly higher than the regulated 29 pressure from the production tubing line, to allow this gas to be preferentially fed into the sales line 30 before production can be resumed from the tubing. A primary switch gauge 18 at this tank prevents further activity from the well, until the pressure has dropped to the supply line pressure, at which point electrical contact is made once more, to allow the well react upon its own ability to undergo further cycling periods.

Between clean-out cycles, gas production is maintained from the smaller, internal production tubing 5 & 13. A secondary pressure switch gauge 17 is installed at a port of the tubing, wired in conductive series with the expansion tank primary switch gauge 18, that allows communication with the conditions that determine further reaction from the well. During the gas feed-off time from the expansion tanks to the sales line 30, the gas well has the ability to recover from its effort, and will start to build up the necessary pressure to initiate another clean-out cycle as the fluids build up to develop the predetermined pressure differential between the tubing and the annulus, and repeat the clean out cycle once more.

The above description of the concept and operation of the invention is adapted primarily, but not limited to, marginal production wells, or wells that have passed their prime, and assures more efficient and complete utilization of our natural resources, and eliminates energy waste caused by conventional gas production methods.

What is claimed:

1. A low pressure system of gas production and liquid removal from gas wells employing a large volume expansion tank, where the well is constructed to contain an open ended internal tubing string, the open, lower end is set at the level of gas producing zones, within a larger external casing, that is cemented into the gas producing formations, and subsequently perforated at the said formations to feed gas from the gas producing zones into an annulus, the space between the larger casing and the smaller tubing; said tubing is open ended to allow free passage of gas and fluid from the annulus into this tubing; the down hole end consists of a retainer, a bottom hole spring, and a steel plunger that is loosely fitted within the tubing string, wherein at a predetermined pressure differential, the tubing valve opens automatically, allowing the plunger's travel upwards, and bring the collected well liquids towards the surface, said liquids and the gas accumulation ahead of the liquids are allowed to discharge to an expansion tank, eliminating the restricted volume, conventional gas separator, designed to accept the volume of gas and well fluids from at least one well clean out cycle, at a reduced pressure, to be subsequently fed into a gas sales line at a controlled pressure; by means of a fully automatic gas well production control system, identified as a, simplified control mechanism means for discharging gas and liquid from the gas well; said means to include two switch gauges to sense the annular and tubing pressure, that are preset to form an electrical circuit when a predetermined pressure differential is reached between the tubing and the annulus, and upon the exhaustion of the gas from the expansion tank to the sales line; said electric circuit means to be energized by means of AC or DC power to operate two time delay relays that are interdependent upon each other to operate one electromagnetic solenoid slave valve, also powered by the same power source, that, upon activation, will open a normally closed fluid and gas discharge line, and close a normally open gas production line from the tubing string, to avoid the discharge of fluid into the gas sales line during the clean out cycle; said discharge and gas production pressure operated line valves, as well as the slave valve to be powered by means of a regulated supply pressure, sourced from the constant, dry and stable gas pressure of the annulus; said valve operation control to be accomplished by the completed switch gauge control circuit means of the first relay that is further controlled by, and dependent upon, the second relay means that maintains a closed electrical circuit to the electromagnetic solenoid slave valve, until a signal from a magnetic sensor, that opens the electric circuit upon the arrival of the steel plunger, at the proximity of the sensor at the top of the tubing string; said first relay means to initiate the gas discharge, and the well clean out cycle, is preset with sufficient time delay to allow the complete exhaustion of the arriving tubing fluid content initiated by the cycle; the cycle is terminated by the preset function of the second relay; said second relay means maintains a closed electrical circuit, until it is deactivated by the means of the steel plunger to sensor magnetic field signal, that acts as the external switch for the second relay; this momentary disruption opens the electric circuit to the solenoid slave valve, thereby closes the valve to the fluid discharge line, reopens the gas production line, and coincidentally, resets the simplified control mechanism for the next well clean out cycle; the accumulated waste fluids collected in the expansion tank to be subsequently transferred by manual or automatic means to a fluid holding tank for disposal.

2. The system of gas production as recited in claim 1., further comprising: two or more expansion tanks connected in series with the first; the first tank to accept the discharged gas and well fluids at a reduced pressure, and the subsequent tanks to accept only the gas from the first expansion tank, to be subsequently fed into a gas sales line at a controlled pressure.

* * * * *